US006182417B1

(12) United States Patent
Keopple

(10) Patent No.: US 6,182,417 B1
(45) Date of Patent: Feb. 6, 2001

(54) ANGULAR BEARING DRIVE FOR PACKAGE GUSSETTING

(75) Inventor: Norbert P. Keopple, New Richmond, WI (US)

(73) Assignee: SIG Pack, Inc., New Richmond, WI (US)

( * ) Notice: Under 35 U.S.C. 154(b), the term of this patent shall be extended for 0 days.

(21) Appl. No.: 09/354,985

(22) Filed: Jul. 16, 1999

(51) Int. Cl.[7] ..... B65B 7/00
(52) U.S. Cl. ..... 53/370.6; 493/184; 53/372.5
(58) Field of Search ..... 53/370.6, 372.2, 53/372.5, 372.7; 74/25, 60; 493/184, 565

(56) References Cited

U.S. PATENT DOCUMENTS

| | | | | |
|---|---|---|---|---|
| 171,572 | | 12/1875 | Juengst . | |
| 2,619,839 | | 12/1952 | Love | 74/60 |
| 5,025,562 | | 6/1991 | Palm | 30/392 |
| 5,234,398 | * | 8/1993 | Larsen | 493/184 |
| 5,275,116 | | 1/1994 | Daley, Jr. | 112/199 |
| 6,050,056 | * | 4/2000 | Weisser et al. | 53/370.6 |

* cited by examiner

*Primary Examiner*—Peter Vo
*Assistant Examiner*—Nathaniel Chukwurah
(74) *Attorney, Agent, or Firm*—Nikolai, Mersereau & Dietz, P.A.

(57) ABSTRACT

A gussetting machine having adjustable spans between the gussetting fingers. The gussetting fingers on opposite sides of a wrapper move in opposite directions driven by rotating a spline shaft which engages a hub having an angled bore therethrough such that the surface of the hub nutates with a pitch and yaw motion. A housing riding on the surface of the hub experiences the pitch and yaw motions. A bracket surrounding the hub has a shaft for allowing the hub to rotate about the pitch axis. A the bracket is pivotably mounted on a pivot block to allow the bracket to yaw. Gussetting arms attached to the brackets swing back and forth in opposite directions simultaneously. The angled bores in the hubs are 180 degrees offset from each other such that the gussetting arms move in unison in opposite directions. The angles of the bores can be increased for larger gussetting arm swings or decreased for smaller gussetting arm swings.

6 Claims, 2 Drawing Sheets

ANGULAR BEARING DRIVE FOR PACKAGE GUSSETTING

BACKGROUND OF THE INVENTION

1. Field of the Invention

This invention relates to changing the rotating motion of a drive shaft into a swinging motion about a pivot point for a gussetting machine.

2. Description of the Related Art

In the past gussetting machines have used complex machinery occupying large areas and using many parts to convert a rotary motion on a drive shaft to a linear motion or a swinging motion and to coordinate the movements of gussetting arms with linear movements of articles to be packaged.

Most gussetting machines use cams with springs to move gussetting arms. These machines have several drawbacks in that they occupy more space, vibrate the entire packaging machine, are very noisy and have parts which wear out.

An improved rotary to linear motion mechanism is needed for smooth, quiet operation of a gussetting machine in a small space. The machine should be long lasting without needing much maintenance during its life and be easily adjustable for different widths and angles of movement.

Other machines have used rotary to linear conversion mechanisms. For example in Juengst U.S. Pat. No. 171,572 a disk on a shaft is angled relative to the shaft to produce a linear motion from the rotation of the shaft. In Love U.S. Pat. No. 2,619,839 two oppositely angled portions of a shaft produce opposite linear motions one, connected to a blade and the other to a counterbalance therefor.

No examples of two oppositely moving gussetting arms with fingers angled to fold wrappers have been found driven by opposing angled cylinders on a drive shaft to produce an arched movement about a pivot point.

SUMMARY OF THE INVENTION

The invention uses two cylinders keyed to a drive shaft such that the cylinders are angled 180 degrees out of phase with each other on the drive shaft. The cylinders are angled relative to the drive shaft at plus and minus $\alpha$ degrees for symmetry of motion and balance of the drive shaft. Hub housings have bearings to provide smooth rolling contact of the hub housings on the cylinders. The gussetting arms have gussetting fingers angled with respect to the gussetting arms to engage a wrapper. The gussetting fingers move in an arc about a pivot point. As the drive shaft rotates the rotary motion of the drive shaft is converted to a small swinging motion to move the gussetting arms. The resulting rotational to arc conversion of motion occurs in a small area. The balanced drive shaft does not vibrate the gussetting machine or make much noise. The hubs can be easily moved linearly along the spline shaft to adjust the position of the gussetting fingers and the hubs can be easily changed to provide a different angle $\alpha$ for pivoting the gussetting finger over a different arc length.

OBJECTS OF THE INVENTION

It is an object of the invention to accurately provide gussetting to packages.

It is an object of the invention to provide gussetting with few moving parts.

It is an object of the invention to change rotary motion to swinging motion with balanced machinery.

It is an object of the invention to change rotary motion to swinging motion in a small space.

It is an object of the invention to change rotary motion to swinging motion with a small arc without using cams, springs or gearboxes.

It is an object of the invention to increase the speed of gussetting.

It is an object of the invention to have a gussetting arm swing about a pivot point.

It is an object of the invention to reduce the noise and vibration of a gussetting arm mechanism.

It is an object of the invention to increase the life and reduce the maintenance of the gussetting arm mechanism.

It is an object of the invention to easily adjust the arc length of the gussetting arms.

It is an object of the invention to easily adjust the distance between the gussetting arm fingers.

It is an object of the invention to coordinate the movement of the gussetting arms with each other and with the size of the product being packaged.

Other objects, advantages and novel features of the present invention will become apparent from the following detailed description of the invention when considered in conjunction with the accompanying drawing.

DESCRIPTION OF THE PREFERRED EMBODIMENTS

Figure 1:
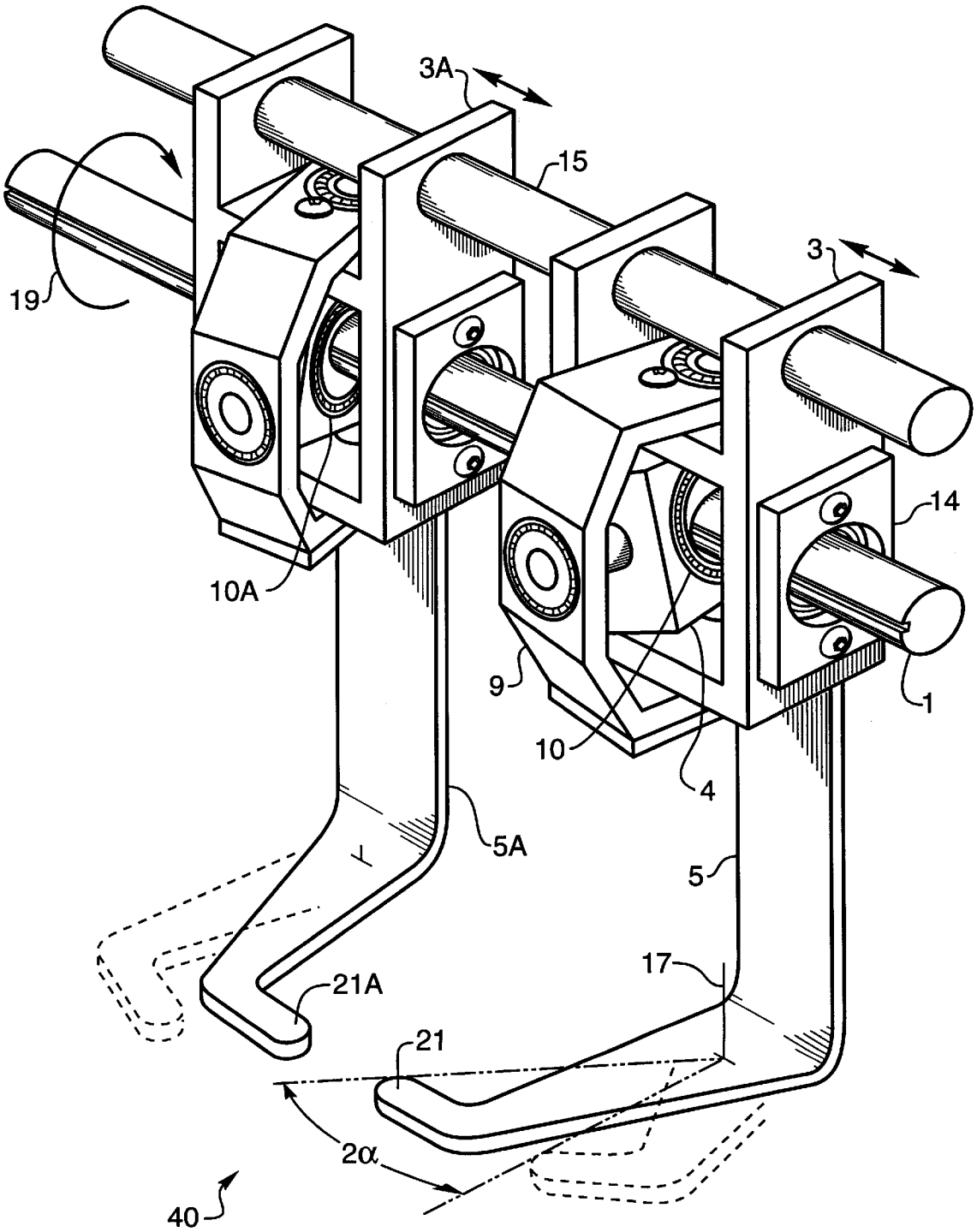
FIG. 1 is a perspective view of the angular bearing drive for package gussetting machine.
Figure 2:
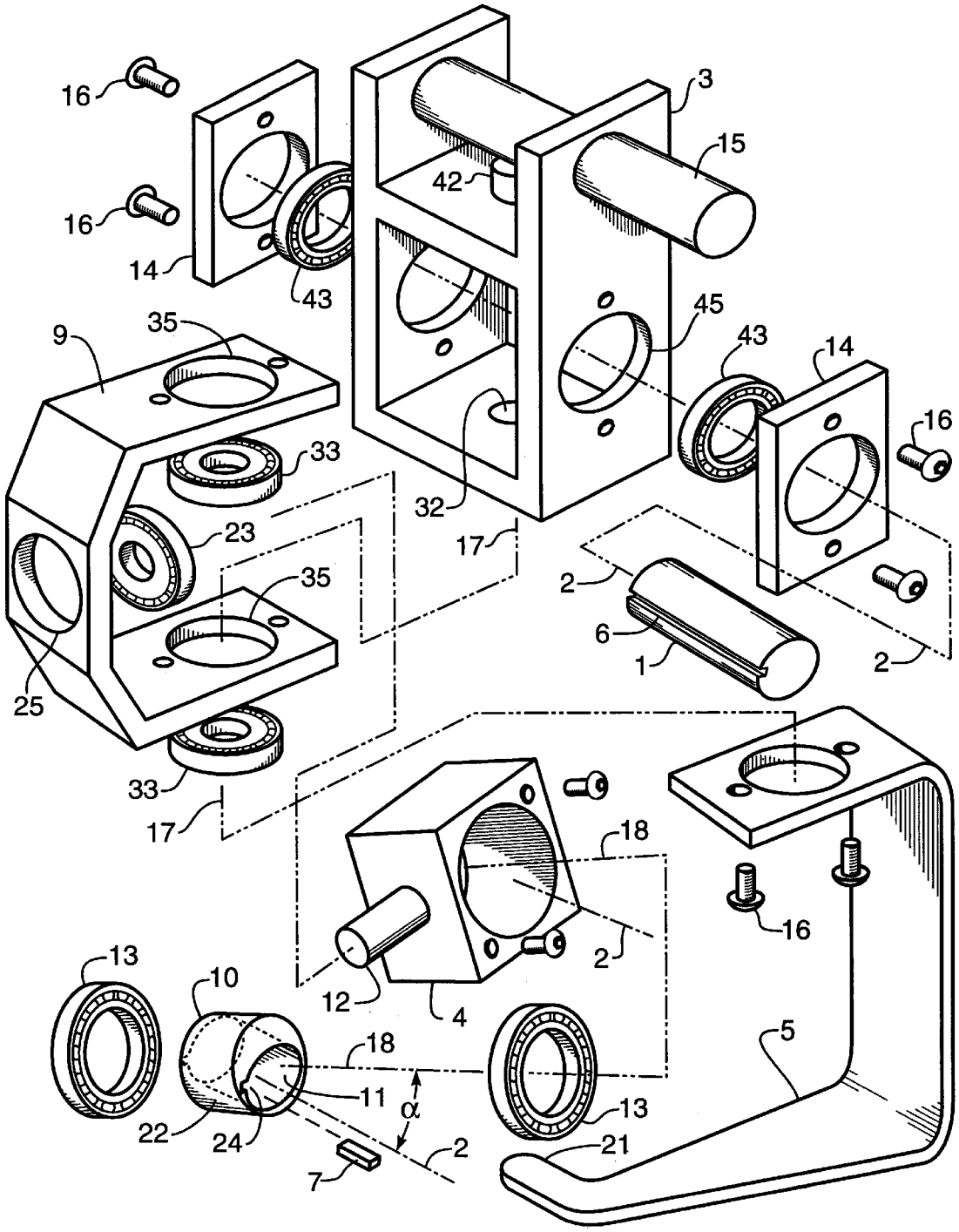
FIG. 2 is an exploded perspective view of the angular bearing drive for package gussetting machine.

FIG. 1 shows a perspective of the angular bearing drive for a package gussetting machine 40. As is seen, the motion of the gussetting fingers 21, 21A is a pivot motion from the phantomed lines to the solid lines over an angle $2\alpha$. In order to produce this motion from the rotation 19 of spline shaft 1, the spline shaft 1 is fitted with a hub 10 as best seen in FIG. 2. The hub has a bore 11 therethrough, the hub axis 18 differs from the spline shaft axis 2 by $\alpha$ degrees. Therefore as the hub 10 rotates the surface of the hub 22 nutates causing a pitch and yaw motion of the surface of the hub 22 relative the spline shaft axis 2. The amount of pitch and yaw can be changed by changing the angle $\alpha$. The hub 10 is fixed to the spline shaft 1 by use of key 7 which engages the hub 10 in hub key groove 24 and the spline shaft 1 in key groove 6. Bearings 13 between hub 10 and hub housing 4 allows for the hub 10 to turn on the spline shaft 1 while the hub housing 4 pitches and yaws relative to the spline shaft axis 2. The stub shaft 12 on hub housing 4 has bearing 23 to rotatably connect the hub housing 4 to bracket 9 at aperture 25 which is perpendicular to the spline shaft axis 2 . The rotation of hub housing 4 on stub shaft 12 in aperture 25 of bracket 9 takes out the pitch motion induced by the rotation of the hub 10 at angle $\alpha$ so that the pitch motion is not experienced by the bracket 9 as the hub housing 4 pitches and yaws.

Bracket 9 is rotatably attached to pivot block 3 by use of bearings 33 on stub shaft 42 such that the bracket 9 rotates in a yaw motion relative to the pivot block 3. The yaw motion is induced by the hub surface 22 nutating due to rotation of the hub 10 at angle $\alpha$. The aperture 35 on bracket 9 should be aligned perpendicular to the spline shaft 2 and perpendicular to aperture 25.

Gussetting arm 5 is attached to the bracket 9 such that it rotates on the axis of stub shaft 42, thus the motion of gussetting arm 5 is yawing back and forth over a range of 2α degrees for each rotation of the spline shaft 1. Finger 21, moves back and forth as shown in FIG. 2 with the phantomed lines showing the gussetting finger 21 in the open position and the solid lines showing the gussetting finger 21 in the closed position for urging a wrapper into a desired position.

The spline shaft 1 extends through aperture 45 in pivot block 3 and rotates on bearings 43 in bearing retainer 14. Stabilizing shaft 15 also passes thought pivot block 3 for stabilizing the assembly. In some embodiments additional stabilizing shafts 15 may be used in conjunction with the pivot block 3. Screws 16 are used to attach the bearing retainer 14 to the pivot block 3.

The distance between the gussetting arms 5, 5A may be adjusted such that the fingers 21, and 21A are closer together or farther apart by moving at least one pivot block along stabilizing shaft 3. Such an adjustment can be made by using a threaded stabilizing bar 15 passing through a threaded pivot block 3 for adjusting the relative positions of the two pivot blocks 3 and 3*a*. Any other means of fixing the positions of the stabilizing shaft 15 relative to the pivot blocks 3 and 3*a* may also be used.

The parts in the second gussetting arm attached to pivot block 3A are the same as those attached to pivot block 3 except the fingers 21 and 21A are pointed in opposite directions and the hub 10A has a hub key groove 24 that is rotated 180 degrees from the hub key groove 24 in hub 10 such that the fingers move in opposite directions in unison. Thus the gussetting fingers 21 and 21A move toward each other or apart from each other at the same time.

The hubs 10 and 10A being 180 degrees out of phase with each other provides for balanced movement of the entire gussetting machine 40 such that there is no vibration caused by the unbalanced movement of parts. The bearings 13, 23, 33 and 43, provide for a smooth long lasting mechanism with little noise, such that rotary motion of the spline shaft 1 is smoothly turned into an arc motion of the gussetting fingers 21 and 21A.

The gussetting machine 40 is compact and uses very few parts. The bearings 13, 23, 33, and 43 should last for a very long time making for a virtually maintenance free gussetting machine 40.

The gussetting fingers 21 and 21A are angled so the fingers 21, 21A point straight toward each other when they swing to their closed position such that other devices (not shown) adjacent to the gussetting machine, like package sealing equipment, can seal the package in a straight line across the wrapper.

By coordinating the spline shaft 1 speed with the length of an item such as a candy bar or package the gussetting fingers 21, 21A will be in place at the right time on each candy bar or other item to be closed by the gussetting machine 40.

The rotary motion of the spline shaft 1 is converted to reciprocation arc motion of the gussetting fingers 21, 21A by the wobble of the surface 22 of hub 10 on the spline shaft 1. By placing the hubs 10, 10A 180 degrees out of phase the gussetting fingers 21, 21A move in unison in opposite directions thus coming together and moving apart exactly as needed to fold and tuck packaging materials in a gussetting operation with a minimum of space taken for machinery. The movements of the gussetting arms 21, 21A are symmetric, balanced and have a small footprint. The bearings 13, 23, 33, 43 rotating on the hubs 10, 10A and the stub shafts 12, 42 create less noise than a cam or gear type rotary to linear conversion mechanism and has a smoother operation than other gussetting machines 40. The smoother the operation the less vibration which can interfere with a smooth wrapper movement and gussetting operation. Further the speeds of the Gussetting machine are easily coordinated with the speed of the linear motion of the object to be wrapped, as the drive spline shaft 1 can be used to drive both the linear motion of the packages to be gussetted and gussetting fingers 21, 21A.

Obviously, many modifications and variations of the present invention are possible in light of the above teachings. It is therefore to be understood that, within the scope of the appended claims, the invention may be practiced otherwise than as specifically described.

What is claimed is:

1. An angular bearing drive for package gussetting comprising:

a spline shaft having a key groove therein, a cylindrical hub having an angled bore therethrough and a key groove in the angled bore, the cylindrical hub inserted on the spline shaft, a key for inserting in the key groove of the spline and the key groove of the cylindrical hub to connect them wherein the cylindrical hub surface pitches and yaws relative to the axis of the spline shaft as the spline shaft rotates, due to the angled bore in the cylindrical hub, a hub housing encasing the cylindrical hub surface such that the housing is driven with a pitch and yaw motion about the spline shaft axis by the cylindrical hub, a stub shaft on the hub housing, a bracket adjacent the hub housing and having a first aperture perpendicular to the axis of the spline shaft for receiving the stub shaft of the hub housing such that the hub housing pivots in the pitch direction relative the spline shaft axis, a second aperture in the bracket, perpendicular to the axis of the spline shaft and perpendicular to the first aperture, a pivot block having a stub shaft for engaging the second aperture in the bracket such that the bracket pivots in the yaw direction relative the spline shaft axis, due to the motion of the surface of the cylindrical hub, a gussetting arm having a gussetting finger, the gussetting arm attached to the bracket for swinging the gus setting arm back and forth as the spline shaft rotates such that the gussetting finger engages a wrapper during a packaging operation.

2. An angular bearing drive for package gussetting as in claim 1 wherein, the gussetting finger is angled relative the gussetting arm.

3. An angular bearing drive for package gussetting as in claim 1 wherein, a stabilizing shaft attached to the pivot block to limit unwanted movement of the gussetting arms.

4. An angular bearing drive for package gussetting as in claim 1 wherein, a second angular bearing drive, on the same spline shaft, adjacent the angular bearing drive, with an angled bore on a second cylindrical hub 180 degrees out of phase with the angled bore in cylindrical hub such that the gussetting arms are driven in opposing directions simultaneously.

5. An angular bearing drive for package gussetting as in claim 4 wherein, a stabilizing shaft attached the pivot blocks of both the angular bearing drive and the second angular bearing drive to limit unwanted movement of the gussetting arms.

6. An angular bearing drive for package gussetting as in claim 5 wherein, the pivot blocks are linearly adjustable along the spline shaft and the stabilizing shaft to adjust the position of the gussetting fingers relative to each other.

* * * * *